US009284797B2

(12) United States Patent
Skinnes et al.

(10) Patent No.: US 9,284,797 B2
(45) Date of Patent: Mar. 15, 2016

(54) BACKUP HEAVE COMPENSATION SYSTEM AND LIFTING ARRANGEMENT FOR A FLOATING DRILLING VESSEL

(75) Inventors: Kenneth Skinnes, Stavanger (NO); Havar Sortveit, Hommersak (NO); Harald Wahl Breivik, Skedsmokorset (NO); Jens Skinnes, Kvernaland (NO)

(73) Assignee: WellPartner AS, Tananger (NO)

( * ) Notice: Subject to any disclaimer, the term of this patent is extended or adjusted under 35 U.S.C. 154(b) by 101 days.

(21) Appl. No.: 14/003,209

(22) PCT Filed: Apr. 26, 2012

(86) PCT No.: PCT/NO2012/050079

§ 371 (c)(1), (2), (4) Date: Sep. 4, 2013

(87) PCT Pub. No.: WO2012/148289

PCT Pub. Date: Nov. 1, 2012

(65) Prior Publication Data

US 2014/0034329 A1 Feb. 6, 2014

Related U.S. Application Data

(60) Provisional application No. 61/480,239, filed on Apr. 28, 2011.

(51) Int. Cl.

| | |
|---|---|
| ***E21B 19/06*** | (2006.01) |
| ***E21B 19/00*** | (2006.01) |
| ***E21B 19/09*** | (2006.01) |

(52) U.S. Cl.

CPC ..... *E21B 19/006* (2013.01); *E21B 19/09* (2013.01)

(58) Field of Classification Search

CPC ..... E21B 19/00; E21B 19/09; E21B 19/002; E21B 19/004; E21B 19/006; E21B 19/08

USPC ..... 166/355, 352; 405/196

See application file for complete search history.

(56) References Cited

U.S. PATENT DOCUMENTS

| | | | |
|---|---|---|---|
| 3,208,728 | A | 9/1965 | Parks |
| 4,004,532 | A | 1/1977 | Reynolds |

(Continued)

OTHER PUBLICATIONS

International Search Report for parent application PCT/NO2012/050079, having a mailing date of Aug. 8, 2012.

(Continued)

*Primary Examiner* — Matthew R Buck
*Assistant Examiner* — Patrick Lambe
(74) *Attorney, Agent, or Firm* — Andrus Intellectual Property Law, LLP

(57) ABSTRACT

A backup heave compensation system and an associated lifting arrangement are for a floating drilling vessel comprising a rig structure with a primary heave compensation system. The backup heave compensation system comprises: a vertically extendable and retractable lifting arrangement; a hydraulic system operatively connected to said lifting arrangement; and a control system operatively connected to said lifting arrangement and hydraulic system for selective control and operation thereof. The lifting arrangement comprises: a rigid frame structure comprised of: at least two vertically extending cylinders; a first transverse element connecting first end portions of said cylinders; and a second transverse element connecting second end portions of said cylinders; and a portal structure comprised of: at least two vertically extending piston rods having first end portions provided each with a piston; and a transverse portal element connecting second end portions of said piston rods. Each piston is movable within a corresponding cylinder.

22 Claims, 7 Drawing Sheets

(56) References Cited

U.S. PATENT DOCUMENTS

Figure 1:
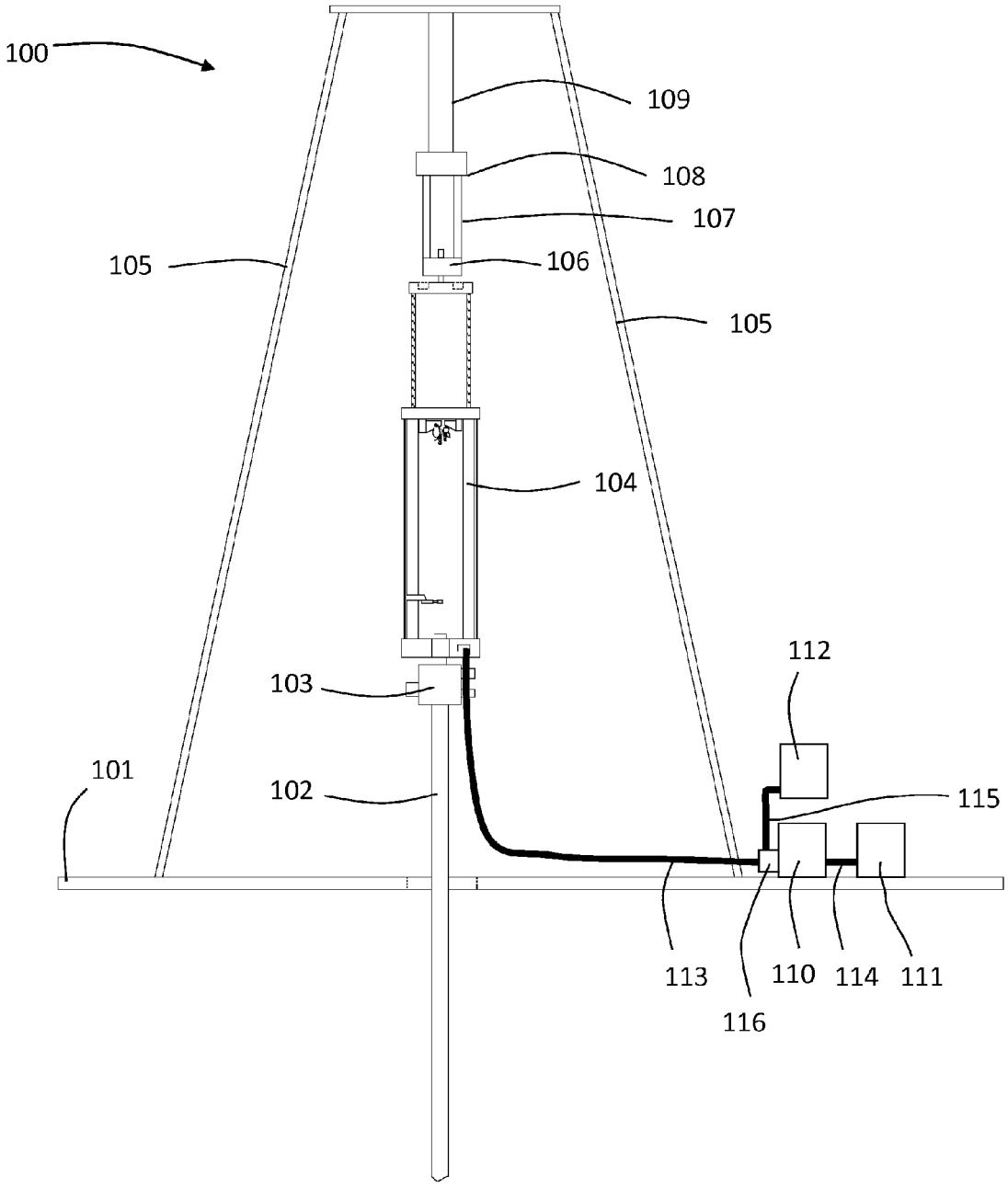

| | | | | |
|---|---|---|---|---|
| 4,039,177 | A | 8/1977 | Person et al. | |
| 2005/0077049 | A1 | 4/2005 | Moe et al. | |
| 2006/0196671 | A1 | 9/2006 | Robichaux | |
| 2012/0018166 | A1 * | 1/2012 | Croatto | 166/355 |

OTHER PUBLICATIONS

Written Opinion for parent application PCT/NO2012/050079, having a mailing date of Aug. 8, 2012.

Australian Patent Examination Report No. 1 for AU 2012248862 dated May 30, 2015.

Animation presented at WTN Multi-Topic Meeting (MTM#11), WellSafe Bail System, cited in Patent Examination Report No. 1, issued by the Australian Patent Office for Australian Patent Application No. 2012248862 on May 30, 2015.

"Motion Compensating Lift Frame Package", The Expro Group Operating and Maintenance Procedures Manual, cited in Patent Examination Report No. 1, issued by the Australian Patent Office for Australian Patent Application No. 2012248862 on May 30, 2015.

Section 27 Notice for Australian Patent Application No. 2012248862 dated Mar. 20, 2015.

Patent Examination Report No. 1 issued on May 30, 2015 by the Australian Patent Office for Australian Patent Application No. 2012248862.

Applicant Response to Patent Examination Report No. 1 for Australian Patent Application No. 2012248862, dated Oct. 16, 2015.

Notice of Acceptance issued by the Australian Patent Office for Australian Patent Application No. 2012248862, dated Nov. 6, 2015.

* cited by examiner

BACKUP HEAVE COMPENSATION SYSTEM AND LIFTING ARRANGEMENT FOR A FLOATING DRILLING VESSEL

CROSS-REFERENCE TO RELATED APPLICATIONS

This application is the U.S. national stage application of International Application No. PCT/NO2012/050079, filed Apr. 26, 2012, which International application was published on Nov. 1, 2012 as International Publication No. WO 2012/148289 A1 in the English language and which application is incorporated herein by reference. The International application claims priority of U.S. Provisional Patent Application No. 61/480,239, filed Apr. 28, 2011, which application is incorporated herein by reference.

AREA OF INVENTION

This invention regards a system, an arrangement and a method capable of functioning as a backup system to primary rig heave compensator systems.

BACKGROUND OF THE INVENTION

Subsea wells offshore are typically developed using floating vessels to accommodate equipment, personnel, and operations necessary to drill and complete a well in order to initiate production of hydrocarbons from a given reservoir forming the target for the well. Additionally, testing and intervention work is typically executed through the use of such floating vessels. It is to be understood, however, that such a floating vessel also could be used in context of other types of subsea wells, for example water or gas injection wells.

It is understood that a floating vessel will be subjected to vertical movement due to the action of the waves of the sea (or a lake), which in turn introduces a challenge with respect to equipment utilized during operations carried out on the floating vessel. Such operations may include, but are not limited to, operations of drilling, completion, well testing, and well intervention. During operation at sea, said equipment will be subjected to vertical movement unless compensated for such movement.

As a floating vessel moves up and down in response to the waves, e.g. a drill string and a drill bit extending down below the vessel from a load-bearing structure, such as a top drive located within a drilling rig, will also move up and down. As it is essential that the weight on the drill bit, i.e. the downward force applied to the bit, is kept as constant as possible, such up and down movements of the drill bit are undesirable and provide for inefficient drilling progress, hence is counterproductive. Heave will remove weight from the drill bit as the rig moves up in conjunction with the high crest of a wave, while weight will be added to the drill bit as the rig moves down into the low point between two waves. Should hydrocarbons start to flow from a reservoir and into a wellbore being drilled, a valve arrangement is utilized to prevent such hydrocarbons from discharging into the natural environment and onto the floating drilling vessel. Such a valve arrangement is commonly referred to as a Blow Out Preventer (BOP), which is capable of sealing around, or cutting and sealing above, a drill pipe cut by shear rams in the BOP.

In other operations, which may include well testing and well intervention, e.g. wireline operations and coiled tubing operations, several sections of a high-pressure riser, commonly referred to as workover riser, are connected between equipment located at the seafloor, such as a subsea wellhead or a subsea Christmas tree, and the floating drilling vessel. The workover riser provides a barrier element for allowing control of pressurized hydrocarbon fluids present in the reservoir, and hence in the wellbore. A subsea valve arrangement, such as a subsea BOP, is also utilized in such operations to provide a system capable of sealing the well in case of an uncontrolled discharge of hydrocarbons from the reservoir. During such operations, hydrocarbon fluids may be present throughout the wellbore and the workover riser, and discharge at surface rig level is typically prevented by means of a valve arrangement located at surface, commonly referred to as a surface flow tree. A surface flow tree, or similar equipment attached to a workover riser, extending upwards from equipment located on the seafloor to the rig, is usually supported by, and kept in tension by, the top drive and drawworks forming part of the drilling rig on a floating drilling vessel. Various types of lifting equipment is utilized to connect the surface flow tree to the top drive, but also to hold the workover riser in tension as required to prevent high loads from acting on the equipment on the seafloor. Such lifting equipment may include, but Is not limited to, rigid bails, tension frames, and soft slings.

Well completion involves the use of production tubulars, which typically extend downwards from the wellhead and the Christmas tree to the producing zones bound by the reservoir(s) targeted by the well(s). Some parts of a completion operation will require equipment to be in tension in a manner similar to that described above. This may comprise setting the upper lock and seal mechanism of the production tubular, commonly referred to as a tubing hanger, inside the wellhead. At this point, a landing string, which is typically made up of several sections of drill pipe, will be connected to said tubing hanger at the wellhead, and also to the top drive at the floating drilling vessel via said lifting equipment. Similar to the description above, the weight of the system is controlled by holding said landing string in tension, thereby maintaining a known force at the level of said tubing hanger.

A vertical movement of a rig, as inflicted by waves of the sea, will impose tensional and compressive forces to said workover riser or landing string and accompanying equipment. These forces may be of a magnitude capable of fracturing or breaking such tubulars or equipment due to stress resulting from these forces. Such failure may, in turn, carry severe consequences, for example personnel injury and death, due to uncontrolled movement of equipment, or due to discharge of hydrocarbons to the surrounding environment, commonly referred to as a "blowout", which may also result in permanent pollution to the natural environment.

In order to avoid such potential severe consequences, it is therefore critical to maintain a stationary position of the equipment and tubular strings discussed above with respect to a geodetic point, such as the seafloor. Hence, it is essential that the vertical movement of the rig is compensated for with respect to this stationary equipment when used for various well operations, for example drilling, completion, well testing, and well intervention. Based on this, all floating drilling vessels are equipped with a heave compensation system for ensuring that a load-bearing unit, such as a top drive, is heave-compensated. This implies that all equipment connected to the top drive, such as equipment located on the seafloor, is not unduly subjected to heave-related forces acting on the floating vessel. A functional heave compensation system is therefore critical to protect such equipment from the effects of heave-related, vertical movement of the floating vessel. Contrary, however, an inoperative and/or malfunctioning heave compensation system may allow for transmission of tensional and compressive forces to said equipment during various well operations, which in turn may result in severe consequences, for example failed equipment, personnel injury and death, and/or discharge of hydrocarbons to the environment (i.e. a "blowout").

It would therefore be advantageous, or even critical in a harsh environment, to provide such a floating vessel with a backup heave compensation system capable of temporarily replacing the main heave compensation system should the main system become Inoperative and/or malfunction.

PRIOR ART AND DISADVANTAGES THEREOF

Floating drilling vessels are generally not equipped with a backup heave compensation system, implying that only one compensation system exists to prevent potential severe consequences of the types described hereinbefore. For this reason, such a floating vessel may therefore comprise a weak link disposed at a known location in the equipment (e.g. a workover riser or a landing string) extending from the drilling rig and down to other equipment (e.g. a subsea BOP) located on the seafloor. Should the main heave compensation system then become inoperative or malfunction during a well operation, the noted weak link will fail so as to prevent failure of critical equipment, such as the subsea BOP, which is required to prevent a blowout should, for example, a workover riser or landing string fail. However, such a weak link arrangement still entails a potential for severe or dramatic consequences, for example failed equipment, personnel injury and death, and/or discharge of hydrocarbons to the surrounding environment.

It would therefore be advantageous, or even critical when in harsh environments, to provide such a floating vessel with a backup heave compensation system capable of temporarily replacing the main heave compensation system should the main system become inoperative and/or malfunctions. Accordingly what is needed is a lifting arrangement capable of being utilized to connect various equipment, for example a surface flow tree or a landing string, to the top drive which is located within the drilling rig. Said lifting equipment further comprises a backup heave compensation apparatus capable of temporarily replacing the primary heave compensation system located on the floating drilling vessel.

US 2005/0077049 A1 appears to represent the closest prior art and discloses an apparatus and a method for protecting against problems associated with the heave of a floating drilling rig. The publication discloses an inline compensator in which a plurality of cylinders and pistons housed within a tubular housing and a plurality of low-pressure and high-pressure accumulators cooperate so as to provide a backup heave compensation system in the event that the primary heave compensation system falls or becomes inoperative. According to this publication, the typical inline compensator utilizes a plurality of hydraulic cylinders that act in opposite directions and that have different piston areas, and such that the piston rods of the cylinders are extended and retracted at different pressure levels to account for heave. More particularly, US 2005/0077049 A1 discloses a pair of inline compensators installed vertically between a hoisting beam and a production head or a surface tree. Parallel piston rods connect the hoisting beam to corresponding pistons within parallel cylinders of the inline compensators, thereby collectively defining a portal structure (or gantry structure). When activated due to inoperation or failure of the primary heave compensation system, this structural arrangement allows the hoisting beam to move up and down as said piston rods move in and out of their respective cylinders to account for heave movements of the floating drilling rig. These undulating, vertical movements of the hoisting beam also imply that the height, or vertical extent, of said portal structure will vary due to heave of the drilling rig. Any equipment rigged up within this portal structure, e.g. wireline equipment, may therefore become adversely affected by such undulating, vertical movements of the hoisting beam. As such, equipment present within the portal structure may collide with the hoisting beam or any other equipment suspended therefrom and/or attached thereto, for example equipment suspended from a hoist attached underneath the hoisting beam. Such adverse affects will obviously provide for an unsafe working environment and potential damage to equipment in vicinity of the inline compensator arrangement.

Further, U.S. Pat. No. 3,208,728 A, U.S. Pat. No. 4,039,177 A and US 2006/0196671 A1 also describe various heave compensation apparatuses for floating drilling or intervention vessels.

OBJECTIVES OF THE INVENTION

The primary objective of the present invention is to remedy or reduce at least one disadvantage of the prior art, or at least to provide a useful alternative to the prior art.

It is also an objective of the invention to provide a backup heave compensation system for the primary rig heave compensation system on a floating drilling vessel. The invention also includes an associated lifting arrangement capable of operating as a backup heave compensator on the drilling vessel. Said backup system is structured in a manner allowing it to be in a static, inoperative position during normal operation of the primary rig heave compensation system. The backup system is also structured in a manner allowing it to become operative, hence allowing it to compensate for heave-related, vertical movements of the floating drilling vessel, should the primary heave compensation system malfunction or become inoperative.

It is further an objective of the present invention to allow for safe handling of said lifting arrangement, but also to allow for safe handling and rig-up of equipment, e.g. wireline equipment, within said lifting arrangement, and by means of lifting and handling equipment associated with the lifting arrangement.

SUMMARY AND GENERAL DESCRIPTION OF THE INVENTION

The objectives are achieved by means of features disclosed in the following description and in the subsequent claims.

According to a first aspect of the invention, a backup heave compensation system on a floating drilling vessel is provided. The drilling vessel comprises a rig structure for carrying out well operations in a subsea well, said rig structure comprising a primary heave compensation system operatively connected to a load-bearing structure capable of supporting a tubular structure connected between the floating drilling vessel and the subsea well, said backup heave compensation system comprising:

- a vertically extendable and retractable lifting arrangement structured for connection between said load-bearing structure and said tubular structure;
- a hydraulic system operatively connected to said lifting arrangement; and
- a control system operatively connected to said lifting arrangement and hydraulic system for selective control and operation thereof;

said lifting arrangement comprising:

a rigid frame structure comprised of: at least two vertically extending legs in the form of cylinders separated at a distance from each other; a first transverse element connecting first end portions of said cylinders; and a second transverse element connecting second end portions of said cylinders; and a portal structure comprised of: at least two vertically extending legs in the form of piston rods having first end portions provided each with a piston; and a transverse portal element connecting second end portions of said piston rods;

wherein each piston of the portal structure is inserted into, and is movable within, a corresponding cylinder of the frame structure, thereby allowing the portal structure and the frame structure to be vertically movable with respect to one another;

wherein said hydraulic system is connected to a high-pressure volume of each cylinder for selective hydraulic communication with said high-pressure volume;

wherein said cylinders are connected to said control system; and wherein the control system is structured in a manner allowing it to selectively control and operate said cylinder-piston arrangement so as to compensate for heave movements of the floating drilling vessel should the primary heave compensation system become inoperative.

Each cylinder may also comprise a low-pressure volume located at the opposite side of each piston relative to said high-pressure volume. Said low-pressure volume may contain a gas, for example air, nitrogen or another suitable gas. Further, said low-pressure volume may be vented to the outside, for example to the outside atmosphere or to a low-pressure gas system.

In one embodiment, said load-bearing structure may comprise a top drive.

Moreover, the first and/or the second transverse element of the rigid frame structure may comprise a rigid, transverse beam.

Furthermore, the transverse portal element of the portal structure may comprise a rigid, transverse beam.

Said cylinder-piston arrangement of the lifting arrangement may also comprise a releasable piston locking system structured for selective locking of said pistons in said cylinders, thereby allowing the portal structure to be locked with respect to the frame structure. Such a piston locking system is useful to ensure that the pistons are fixed at a desired position, for example in a mid-position, in the cylinders when the lifting arrangement is in a static, inoperative position in an operational mode, i.e. after the rig-up mode, which is during normal operation of the primary rig heave compensation system. As such, the releasable piston locking system may comprise at least one pressure-containment means structured for selective locking of a given hydraulic pressure in said high-pressure volume of each cylinder. Said pressure-containment means may comprise e.g. a suitable valve means. Further, the piston locking system may comprise at least one mechanical lock structured for selective locking of the pistons to said cylinders. Moreover, said mechanical lock may be hydraulically operated. Yet further, the piston locking system may be operatively connected to said control system for selective control and operation of the piston locking system.

Figure 2:
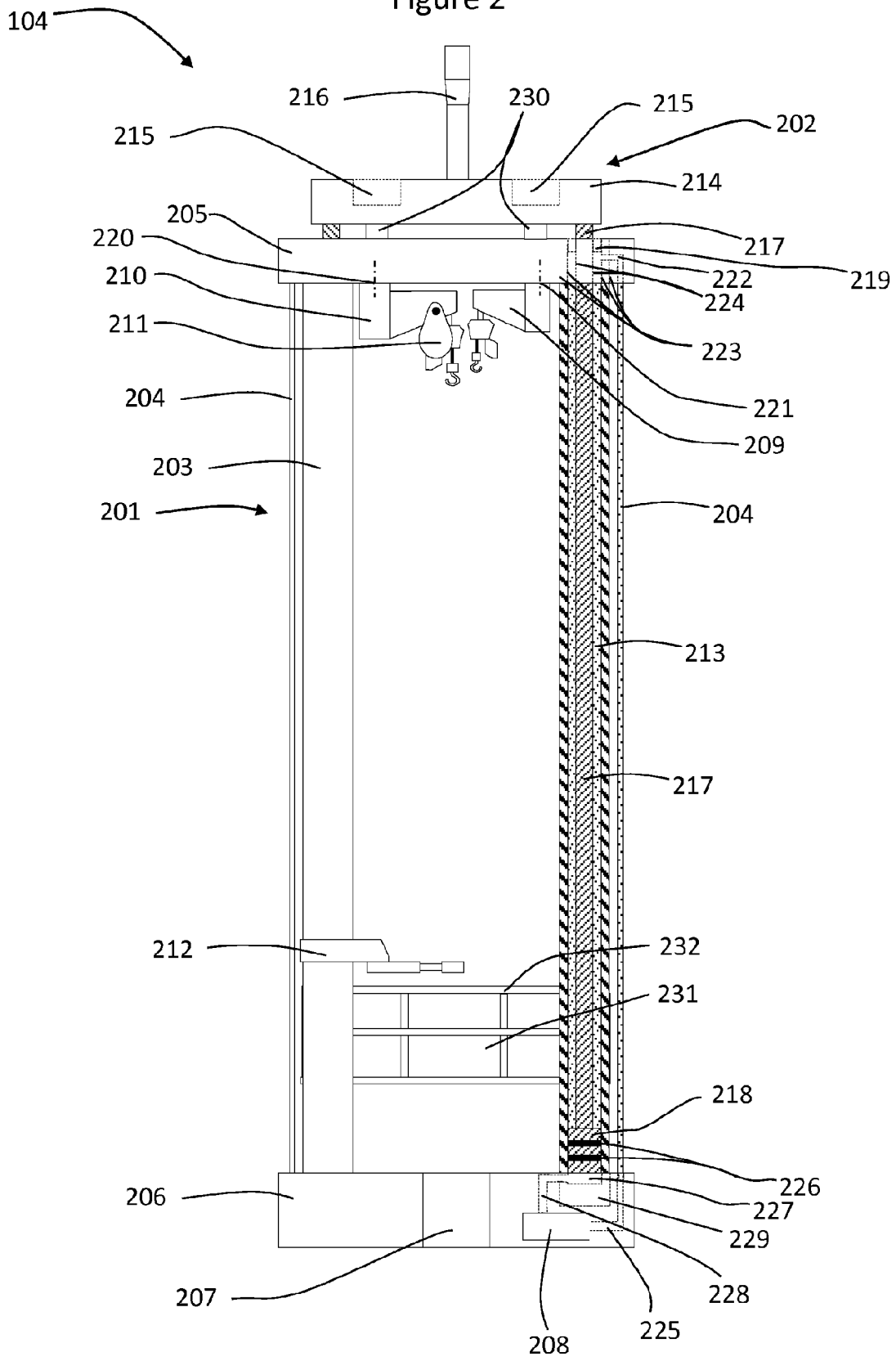

Furthermore, the lifting arrangement of the backup heave compensation system may comprise a releasable frame locking system structured for selective locking of the rigid frame structure to the portal structure when the lifting arrangement is retracted in a rig-up mode. Such a frame locking system is useful to ensure that the piston rods of the portal structure are fixed in a fully retracted state within the cylinders of the frame structure during rig-up. As such, the releasable frame locking system may comprise at least one mechanical lock. Said mechanical lock may be arranged between the rigid frame structure and said transverse portal element of the portal structure, such as shown in FIG. 2 below. Said mechanical lock may be hydraulically operated. Yet further, the frame locking system may be operatively connected to said control system for selective control and operation of the frame locking system.

In another embodiment, the portal structure may be positioned above the rigid frame structure so as to form an upper part of said lifting arrangement, whereby the frame structure forms a lower part of the lifting arrangement. When structured in this manner, the transverse portal element of the rigid portal structure may comprise a connection interface for releasable connection to the load-bearing structure of said rig structure.

According to this embodiment, said first transverse element forms an upper transverse element of the frame structure, and said second transverse element forms a lower transverse element of the frame structure;

wherein the lower transverse element of the frame structure comprises a connection interface for releasable connection to equipment to be lifted and connected to said tubular structure, which is connected between the floating drilling vessel and the subsea well.

Further to this embodiment, the frame structure may comprise at least one lifting device for releasable connection to equipment to be lifted with respect to said lifting arrangement. As such, said lifting device may comprise at least one winch. Said lifting device may also be connected to the upper transverse element of the frame structure.

Yet further to this embodiment, the frame structure may comprise at least one movable manipulator arm for guiding equipment to be moved with respect to said lifting arrangement. As such, said movable manipulator arm may be connected to the lower transverse element of the frame structure. As an alternative or addition, said movable manipulator arm may be connected to at least one of said cylinders of the frame structure. According to this embodiment, the frame structure may also comprise a work platform for carrying out various well-related work, for example rig-up work, wireline operations, coiled tubing operations, etc.

In an alternative embodiment, the portal structure may be positioned below the rigid frame structure so as to form a lower part of said lifting arrangement, whereby the frame structure forms an upper part of the lifting arrangement. When structured in this manner, said first transverse element forms an upper transverse element of the frame structure, and said second transverse element forms a lower transverse element of the frame structure;

wherein said upper transverse element of the frame structure comprises a connection interface for releasable connection to the load-bearing structure of said rig structure.

According to this alternative embodiment, the transverse portal element of the portal structure may form a lower transverse portal element of the portal structure;

wherein the lower transverse portal element of the portal structure comprises a connection interface for releasable connection to equipment to be lifted and connected to said tubular structure, which is connected between the floating drilling vessel and the subsea well.

Further to this alternative embodiment, said lower transverse element of the frame structure may comprise at least one lifting device for releasable connection to equipment to be lifted with respect to said lifting arrangement. As such, said lifting device may comprise at least one winch.

Yet further to this alternative embodiment, said transverse portal element of the portal structure may comprise at least one movable manipulator arm for guiding equipment to be moved with respect to said lifting arrangement. The frame structure and/or the portal structure may also comprise a work platform for carrying out various well-related work, for example rig-up work, wireline operations, coiled tubing operations, etc.

Said tubular structure, which is connected between the floating drilling vessel and the subsea well, may also comprise e.g. a so-called workover riser or a landing string.

In another embodiment of the backup heave compensation system, said piston rods of the portal structure in the lifting arrangement may be hollow;

wherein the second end portion of each piston rod is structured for communicating a hydraulic fluid with said control system and hydraulic system; and wherein the first end portion of each piston rod is structured for communicating said hydraulic fluid between the hollow piston rod and the corresponding cylinder surrounding the piston rod. This allows the hydraulic fluid to flow back and forth between each piston rod and said control system/hydraulic system. It also allows the hydraulic fluid to flow back and forth between each hollow piston rod and corresponding cylinder. As such, the first end portion of each piston rod may be provided with at least one flow port for communicating the hydraulic fluid between the hollow piston rod and the corresponding cylinder. As an alternative or addition, the first end portion of each piston rod may be provided with a piston having at least one flow port for communicating the hydraulic fluid between the hollow piston rod and the corresponding cylinder. This embodiment allows the overall weight of the lifting arrangement to be reduced significantly, which again is of great importance on a floating drilling vessel.

According to a second aspect of the invention, a lifting arrangement capable of operating as a backup heave compensator on a floating drilling vessel is provided. The lifting arrangement comprises:

a rigid frame structure comprised of: at least two parallel legs in the form of cylinders separated at a distance from each other; a first transverse element connecting first end portions of said cylinders; and a second transverse element connecting second end portions of said cylinders; and a portal structure comprised of: at least two parallel legs in the form of piston rods having first end portions provided each with a piston; and a transverse portal element connecting second end portions of said piston rods;

wherein each piston of the portal structure is inserted into, and is movable within, a corresponding cylinder of the frame structure, thereby allowing the portal structure and the frame structure to be movable with respect to one another;

wherein a high-pressure volume of each cylinder is structured for hydraulic communication with an associated hydraulic system; and wherein said cylinders are structured for connection to an associated control system for selective control and operation of said hydraulic system and said cylinder-piston arrangement so as to compensate for heave movements of the floating drilling vessel.

Each cylinder may also comprise a low-pressure volume located at the opposite side of each piston relative to said high-pressure volume. Said low-pressure volume may contain a gas, for example air, nitrogen or another suitable gas. Further, said low-pressure volume may be vented to the outside, for example to the outside atmosphere or to a low-pressure gas system.

The first and/or second transverse element of the rigid frame structure may comprise a rigid, transverse beam.

Moreover, the transverse portal element of the portal structure may comprise a rigid, transverse beam.

Furthermore, said cylinder-piston arrangement may comprise a releasable piston locking system structured for selective locking of said pistons in said cylinders, thereby allowing the portal structure to be locked with respect to the frame structure. Such a piston locking system is useful to ensure that the pistons are fixed at a desired position, for example in a mid-position, in the cylinders when the lifting arrangement is in a static, inoperative position in an operational mode, i.e. after the rig-up mode, which is during normal operation of the primary rig heave compensation system. As such, the releasable piston locking system may comprise at least one pressure-containment means structured for selective locking of a given hydraulic pressure in said high-pressure volume of each cylinder. Said pressure-containment means may comprise e.g. a suitable valve means. Further, the piston locking system may comprise at least one mechanical lock structured for selective locking of the pistons to said cylinders. Said mechanical lock may be hydraulically operated. Yet further, the piston locking system may be structured for connection to said control system for selective control and operation of the piston locking system.

Moreover, the lifting arrangement may comprise a releasable frame locking system structured for selective locking of the rigid frame structure to the portal structure when the lifting arrangement is retracted in a rig-up mode. Such a frame locking system is useful to ensure that the piston rods of the portal structure are fixed in a fully retracted state within the cylinders of the frame structure during rig-up. As such, the releasable frame locking system may comprise at least one mechanical lock. Said mechanical lock may be arranged between the rigid frame structure and said transverse portal element of the portal structure, such as shown in FIG. 2 below. Further, said mechanical lock may be hydraulically operated. Yet further, the frame locking system may be structured for connection to said control system for selective control and operation of the frame locking system.

In one embodiment, the transverse portal element of the portal structure may comprise a connection interface for releasable connection to a load-bearing structure on said floating drilling vessel. According to this embodiment, the second transverse element of the frame structure may also comprise a connection interface for releasable connection to equipment to be lifted via the lifting arrangement. Further to this embodiment, the frame structure may comprise at least one lifting device for releasable connection to equipment to be lifted with respect to the lifting arrangement. As such, said lifting device may comprise at least one winch. Said lifting device may also be connected to the first transverse element of the frame structure.

Yet further to this embodiment, the frame structure may comprise at least one movable manipulator arm for guiding equipment to be moved with respect to the lifting arrangement. As such, said movable manipulator arm may be connected to the second transverse element of the frame structure. As an alternative or addition, said movable manipulator arm may be connected to at least one of said cylinders of the frame structure. According to this embodiment, the frame structure may also comprise a work platform.

In an alternative embodiment, the first transverse element of the frame structure may comprise a connection interface for releasable connection to a load-bearing structure on said floating drilling vessel.

Further to this alternative embodiment, the transverse portal element of the portal structure may comprise a connection Interface for releasable connection to equipment to be lifted via the lifting arrangement.

Yet further to this alternative embodiment, the second transverse element of the frame structure may comprise at least one lifting device for releasable connection to equipment to be lifted with respect to the lifting arrangement. As such, said lifting device may comprise at least one winch.

Furthermore, the transverse portal element of the portal structure may also comprise at least one movable manipulator arm for guiding equipment to be moved with respect to the lifting arrangement. According to this alternative embodiment, the frame structure and/or the portal structure may also comprise a work platform for carrying out various well-related work, for example rig-up work, wireline operations, coiled tubing operations, etc.

In another embodiment of the lifting arrangement, said piston rods of the portal structure may be hollow;

wherein the second end portion of each piston rod is structured for communicating a hydraulic fluid with said control system and hydraulic system; and wherein the first end portion of each piston rod is structured for communicating said hydraulic fluid between the hollow piston rod and the corresponding cylinder surrounding the piston rod. This allows the hydraulic fluid to flow back and forth between each piston rod and said control system/hydraulic system. It also allows the hydraulic fluid to flow back and forth between each hollow piston rod and corresponding cylinder. As such, the first end portion of each piston rod may be provided with at least one flow port for communicating the hydraulic fluid between the hollow piston rod and the corresponding cylinder. As an alternative or addition, the first end portion of each piston rod may be provided with a piston having at least one flow port for communicating the hydraulic fluid between the hollow piston rod and the corresponding cylinder. When structured in this manner, the overall weight of the lifting arrangement may be reduced significantly, which again is of great importance on a floating drilling vessel.

As such, the invention presented herein comprises, among other things, a lifting arrangement to be utilized to connect equipment extending from e.g. a subsea wellhead, or from a Christmas tree, to e.g. a top drive on a floating drilling vessel. Such equipment may be utilized in various well operations, for example well completions, well testing, and well interventions. The invention further comprises a backup heave compensation system capable of being in a static mode or in an operative mode, the modes of which are further controlled by the status of the primary heave compensation system present on a floating drilling vessel. The invention further comprises functionality for ensuring safe handling of the lifting arrangement itself in addition to safe handling and rig-up of equipment placed within the lifting arrangement, such as equipment related to well intervention operations, for example wireline operations and coiled tubing operations.

In one preferred embodiment, the invention comprises a lifting arrangement equipped with a series of components forming parts of a backup heave compensation system and further simplifying rig-up for various well operations, for example well completions, well testing, and well interventions. Further to this preferred embodiment, such components comprise a lower frame part and an upper frame part, the parts of which provide both mutual and individual functionality critical for the objective of the invention. Mutual functionality is related to a backup heave compensation system, while individual functionality is related to components required to allow for safe handling of the lifting arrangement and, additionally, components which allow for safe handling and rig-up of equipment within the lifting arrangement.

In alternative embodiments, the individual functionality of the upper and lower frame parts may be opposite, further meaning that the lifting arrangement still have the same purpose, but components and individual functionality is opposite. However, the mutual functionality related to a backup heave compensation system is the same.

In one embodiment of the present invention, the lower frame is represented by a rigid structure comprising a rigid lower beam, a rigid upper beam, and intermediate rigid legs connecting the upper and lower beams. The rigid legs are shaped as cylinders, each capable of holding a piston-and-rod arrangement within a cylinder, and further to provide required seals and fluid communication ports to accommodate for a hydraulic cylinder system. Further to this embodiment, said upper frame is represented by a rigid structure comprising a rigid upper beam and rigid legs connected to the upper beam. The rigid legs are shaped as piston rods connected each to a piston at the lower end thereof. The piston rods and pistons are shaped so as to fit into the cylinder-shaped legs of the lower frame, thereby forming an extendable frame once the pistons and piston rods are inserted and connected inside the cylinder-shaped legs of the lower frame. The pistons, piston rods, and the cylinders collectively form a hydraulic system capable of being operated and controlled through use of hydraulic means and/or electric means, as understood by one skilled in the art. In this context, electric means may refer to sensing devices used to convey various types of information, for example relative positions of the pistons within the cylinders, and/or pressures within high and low-pressure volumes of said cylinders.

Further to a preferred embodiment, the lower frame may comprise a rigid upper beam, a rigid lower beam, and cylinder-shaped legs comprising components for enabling safe handling of said lifting arrangement during rig-up. The upper and lower beams of the lower frame may be equipped with a hook system capable of holding the weight of the complete lifting arrangement during rig-up, which is beneficial to ensure safe handling. The upper and lower beams are further equipped with lifting points enabling a balanced handling of the complete lifting arrangement according to the invention. The lower rigid beam is equipped with an interface to typical valve arrangements, such as a surface flow tree, and/or equipped with a releasable locking system, which may be operated hydraulically and/or mechanically.

Further to the preferred embodiment, the lower frame may be equipped with components for allowing safe handling and rig-up of equipment within the lifting arrangement described herein. As such, the upper beam of the lower frame may be equipped with one or several winches utilized to lift equipment into and out of the lifting arrangement during well operations, for example wireline operations or coiled tubing operations. One skilled in the art will understand that such a winch may be of a hydraulic type or an electrical type. The lower frame may further comprise a manipulator arm capable of guiding equipment into and out of the frame, further preventing sideways movement and related hazards pertaining to a hanging load. Said manipulator arm will provide vertical, horizontal, and rotational movement. One skilled in the art will understand that such a manipulator arm may be attached to one of the cylinder-shaped legs, or to the lower rigid beam of the lower frame. The lower frame may further comprise a work platform to provide a safe working environment for personnel required during handling of equipment rigged up within the lifting arrangement described herein. In this context, handling may refer to rig-up sequences and also to maintenance of equipment located within and/or being a part of the frame. It should further be noted that the lower frame provides for a predefined distance between the upper and lower rigid beams of the lower frame, which in turn implies that said predefined distance remains unchanged in all situations, including a situation where the upper frame is extended or retracted in relation to the lower frame, which in turn implies that equipment rigged up within the lower frame, for example wireline equipment, will not be affected by the relative movement between the upper and lower frame parts. One skilled in the art will understand benefits related to this predefined distance as it provides for a safe working environment for personnel situated within, and the equipment rigged up within, the lower frame and, further, that collisions are avoided in situations where the upper frame is extended or retracted in relation to the lower frame.

Further to the preferred embodiment, the upper frame may comprise a rigid upper beam and piston rod-shaped legs, and the upper frame may also be equipped with components for allowing safe handling of the lifting arrangement during rig-up. The rigid upper beam may be equipped with a sub shaped to Interface with lifting equipment forming part(s) of the drilling rig, such as an elevator system. Further, the rigid upper beam may be equipped with two connection points shaped to interface with other typical lifting equipment utilized in drilling rigs, such as rigid bails. One skilled in the art will understand the various types of lifting equipment and interfaces described herein.

One skilled in the art will understand that the position of the rigid upper beam of the upper frame can be changed in relation to the rigid upper beam of the lower frame. This change may be carried out by manipulation of a hydraulic system connected to the present piston-cylinder arrangement once the upper and lower frame parts are connected via said piston-and-cylinder components. The lifting arrangement may comprise a releasable frame locking system, e.g. a mechanical frame locking system including one or more releasable mechanical locks, providing a frame locking functionality when the piston is fully retracted into the cylinders, further entailing that the rigid upper beam of the upper frame will be located adjacent to the rigid upper beam of the lower frame. Such a frame locking system and locking functionality can be controlled externally so as to alternate between rig-up mode and operational mode for the lifting arrangement, where each mode may include different mechanical strength ratings. This functionality may be included as it may prove beneficial to allow for a higher mechanical strength during rig-up as compared to an operational setting. It should be noted, however, that different mechanical settings are not a requirement for the invention presented herein, but merely a functionality that may be beneficial in some settings.

The preferred embodiment may further comprise a hydraulic circuit to allow for operation of the hydraulic compensation functionality of the lifting arrangement. One skilled in the art will understand that such a hydraulic circuit can be shaped in various ways, but for the preferred embodiment it is illustrated as follows: the upper side of the pistons represent a high-pressure chamber filled with hydraulic fluid, while the lower side of the piston represent a low-pressure chamber which may be filled with a gas, for example air or nitrogen. The high-pressure chambers are connected to external conduits via flow ports in the top of the cylinders, where said conduits are placed along the external side of the cylinders. Alternatively, the high-pressure chambers may be connected, via the inside of hollow piston rods, to hydraulic conduits connected to flow ports in the top of the piston rods. These conduits are further connected to a manifold and a control system required to operate all system functionality related to the lifting arrangement. It should be noted that winches and manipulator arm part of the lower frame may be connected via the same conduits and control system. The control system described herein may comprise components required for system functionality related to operation of components included therein and for automatic activation of the backup heave compensation system, whereby the mode of the lifting arrangement may be changed from a static mode to a heave compensated mode.

This in turn is related to the operational status of the primary heave compensation system available on the floating drilling vessel. The components in the control system may comprise e.g. pressure and/or temperature sensors, hydraulic valves, safety valves, automated valves, pressure relief valves, and rupture discs, all of which are components understood by one skilled in the art. It should be noted that the control system may be part of the lifting arrangement, but one skilled in the art will understand that such a control system may also be placed in other locations having cabled and/or wireless communication with all relevant conduits and system components.

The control system may be further connected, via a conduit, to an accumulator system and a hydraulic pumping unit which may be placed in a nearby location. The accumulator system may be part of the lifting arrangement or, as described for the preferred embodiment, a separate unit placed at a near location, and further connected to a volume of gas, for example nitrogen bottles or a gas compressor. The accumulator system may comprise one or several cylinder bodies, where each cylinder body may comprise two chambers separated internally by a moving piston arrangement. The lower side of the piston may represent a high-pressure hydraulic fluid chamber connected to the control system of the lifting arrangement via a conduit, while the upper side of the piston may represent a high-pressure gas chamber connected to the volume of pressurized gas described herein. The hydraulic pumping unit will be connected to the control system of the lifting arrangement via a conduit, and the control system can be used to direct hydraulic fluid from the hydraulic pumping unit to all hydraulic systems incorporated in the system represented by the invention herein.

The lifting arrangement may be changed from a rig-up mode to an operational mode by extending the upper frame with respect to the lower frame and into a mid-position, further implying that that the piston parts of the upper frame will be placed in the centre of the cylinder parts of the lower frame. As mentioned above, the lifting arrangement may comprise a mechanical lock to be used during rig-up and handling of the lifting arrangement. By manipulation of the control system, this locking mechanism is opened and followed by pressurizing the accumulators with gas pressure to a predetermined value, which will be in accordance with the weight of the components extending from the rig to the subsea equipment, for example a workover riser. Alternatively, the accumulators are pressurized, as described herein, prior to opening the locking mechanism described herein. The rig-load support element, such as a top drive, is utilized to ensure tension in the system. Once the accumulators are pressurized with gas, the control system is manipulated further to establish hydraulic fluid communication between the cylinder parts of the lifting arrangement and the accumulators, whereupon the mechanical locks can be opened and the top drive can be elevated to extend the hydraulic pistons into a mid-position in the cylinders. System pressure of the lifting arrangement is then tuned to a predetermined value in accordance with the weight of the workover riser and recommended tension, after which the hydraulic fluid communication between the cylinders and accumulator is closed. This procedure ensures that the system is set to an operational mode so as to provide a backup heave compensation system. Operation of the control system may be carried out from a remote location, for example from the driller's cabin.

In a preferred embodiment of the invention, the control system may comprise several stages of functionality related to the automatic activation of the backup heave compensation system, which includes the lifting arrangement. In a situation where a primary heave compensator in a rig cease to operate in a normal manner, vertical movement as inflicted by the waves of the sea will apply compressive and tensional forces to the piston/cylinder arrangements, which in turn will result in pressure decreases and increases, respectively, within a high-pressure volume within the cylinders. A first stage activation comprises components required to sense a positive or negative differential pressure (i.e. pressure difference) exceeding a predetermined value, whereupon an electronic circuit will execute actions necessary to operate a valve so as to allow hydraulic fluid to move between the cylinder parts of the lifting arrangement and the accumulator.

A second stage of the control system may comprise a mechanically operated pressure relief valve which, upon a predetermined pressure change, will open so as to allow hydraulic fluid to move between the cylinder parts of the lifting arrangement and the accumulator.

A third stage of the control system may comprise a mechanical rupture system which, upon a predetermined pressure change, will break so as to allow hydraulic fluid to move between the cylinder parts of the lifting arrangement and the accumulators.

The three stages of automatic activation of the backup system described above will cause the upper frame of the lifting arrangement to move up and down in relation to the lower frame as the floating drilling vessel moves up and down as inflicted by the waves of the sea. In such a situation, the upper rigid beam of the upper frame will move up and down in relation to the upper rigid beam of the lower frame, and hence in relation to the lower frame. The upper rigid beam and lower rigid beam of the lower frame, however, remain stationary in relation to each other, further implying that personnel situated within, and equipment rigged up within, the lower frame, for example wireline personnel and equipment, will not be in danger of collision with any moving parts of the lifting arrangement comprised of the upper and lower frame parts.

One skilled in the art will understand that the description of the control system, and also the operation of the lifting arrangement disclosed herein, is based on the use of one control system and method, but that several other control systems and methods can be utilized to achieve the same system functionality.

SHORT DESCRIPTION OF THE FIGURES OF THE EMBODIMENTS

The invention will now be described by way of non-limiting embodiments of the invention, referring also to the accompanying figures, in which:

FIG. 1 describes a simplified example of one embodiment of the invention.

FIG. 2 describes examples of preferred general system features for a generalised embodiment of the invention.

Figure 3:
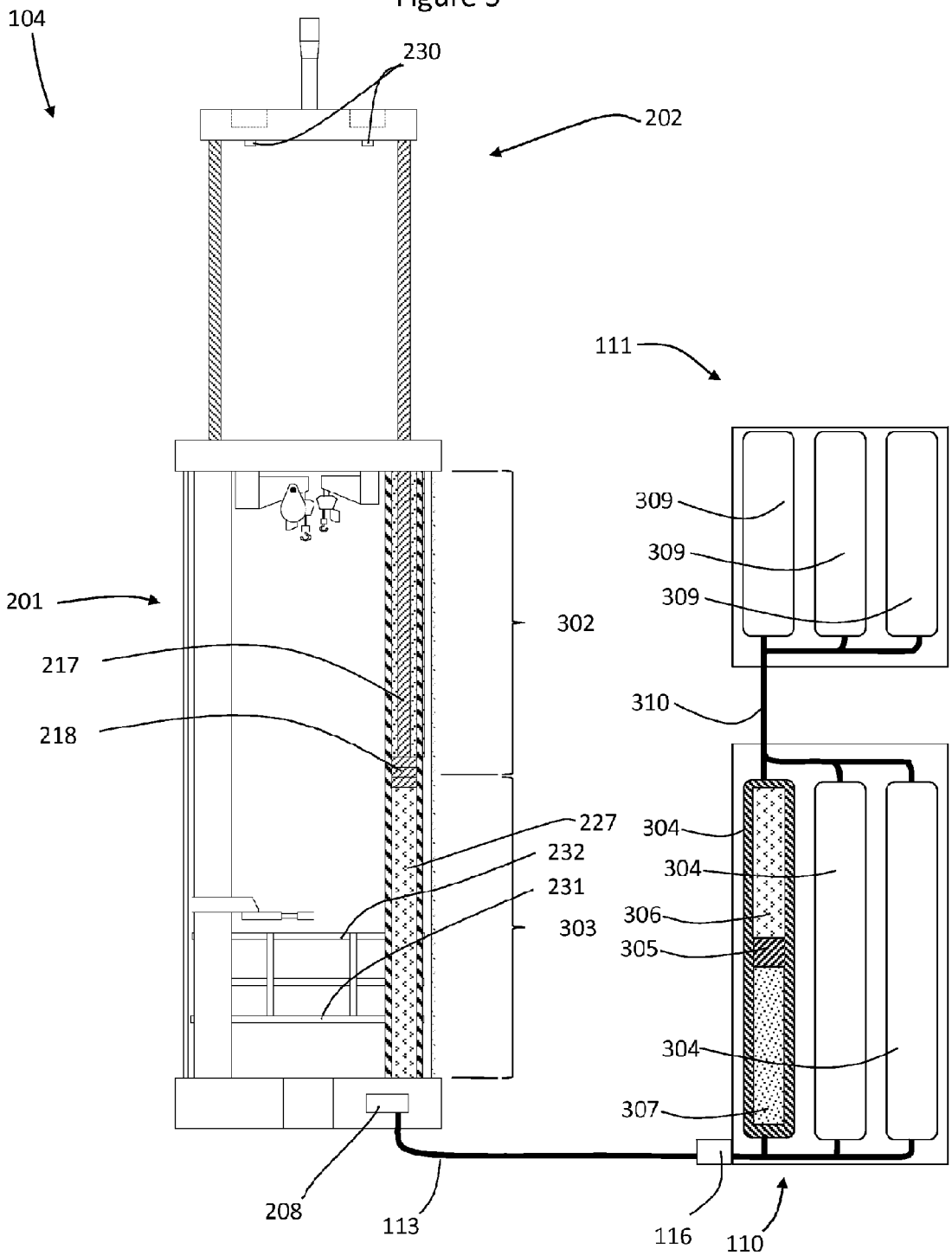

FIG. 3 describes an operational mode of the present invention.

Figure 4:
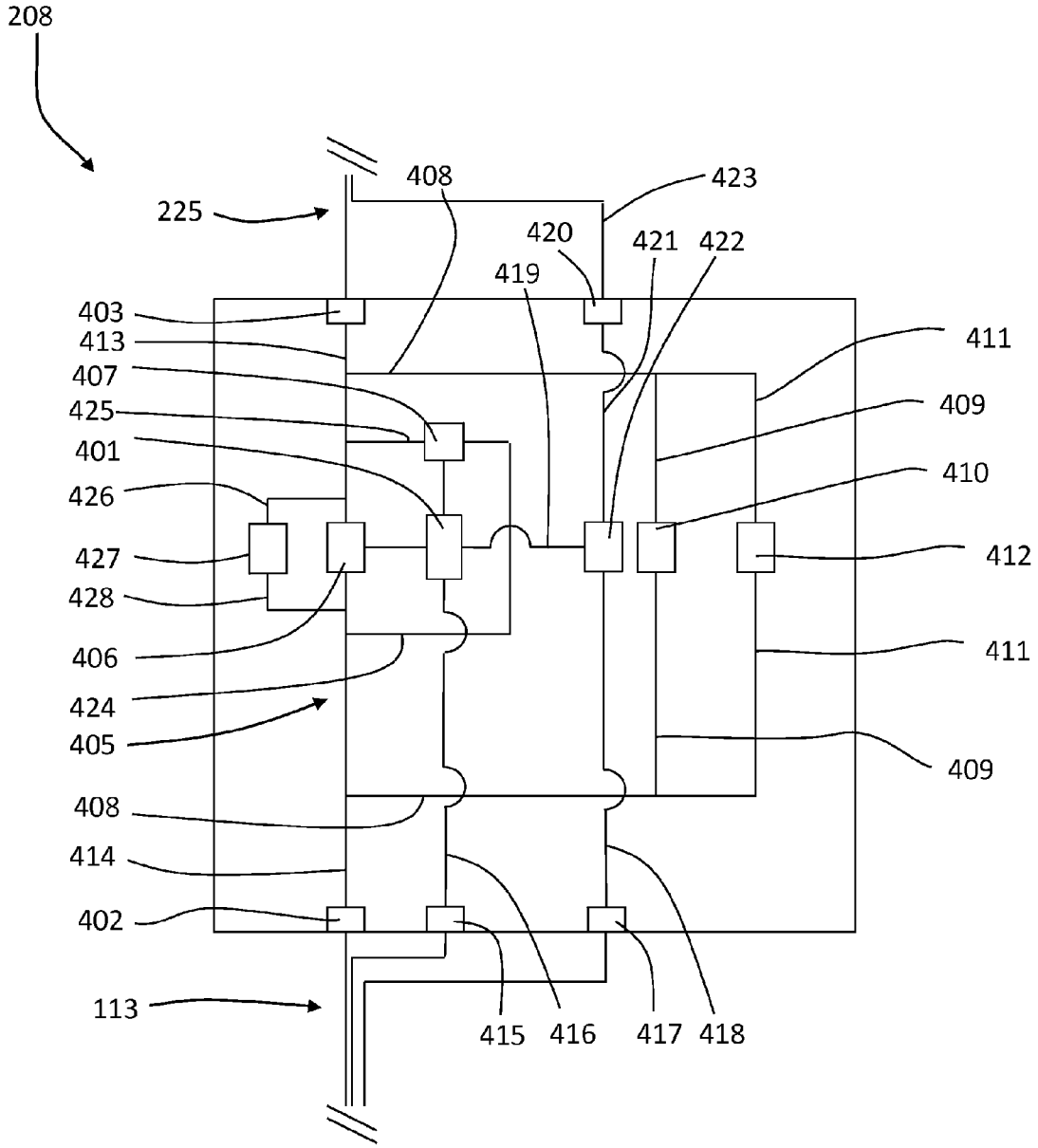

FIG. 4 describes an example of a control system which may be used in relation to the present invention.

Figure 5:
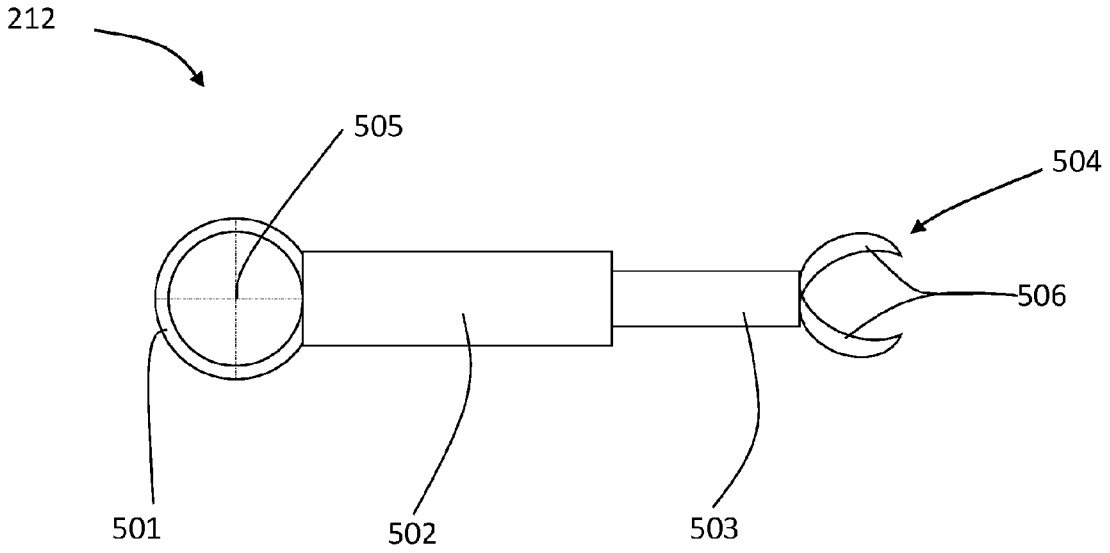

FIG. 5 describes one embodiment of a manipulator arm which may be part of the present invention.

Figure 6:
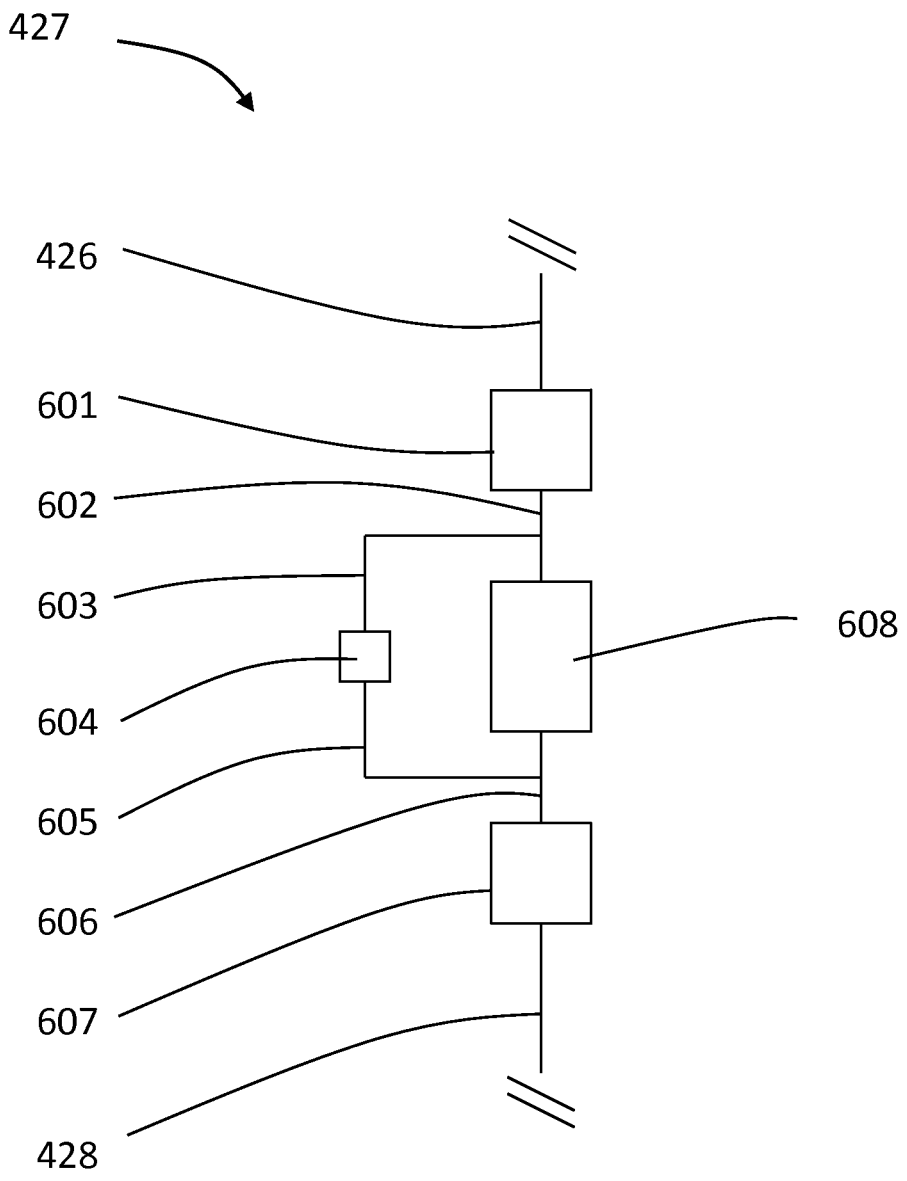

FIG. 6 describes one embodiment of a pressure compensation unit which may be part of the control system part of the present invention.

Figure 7:
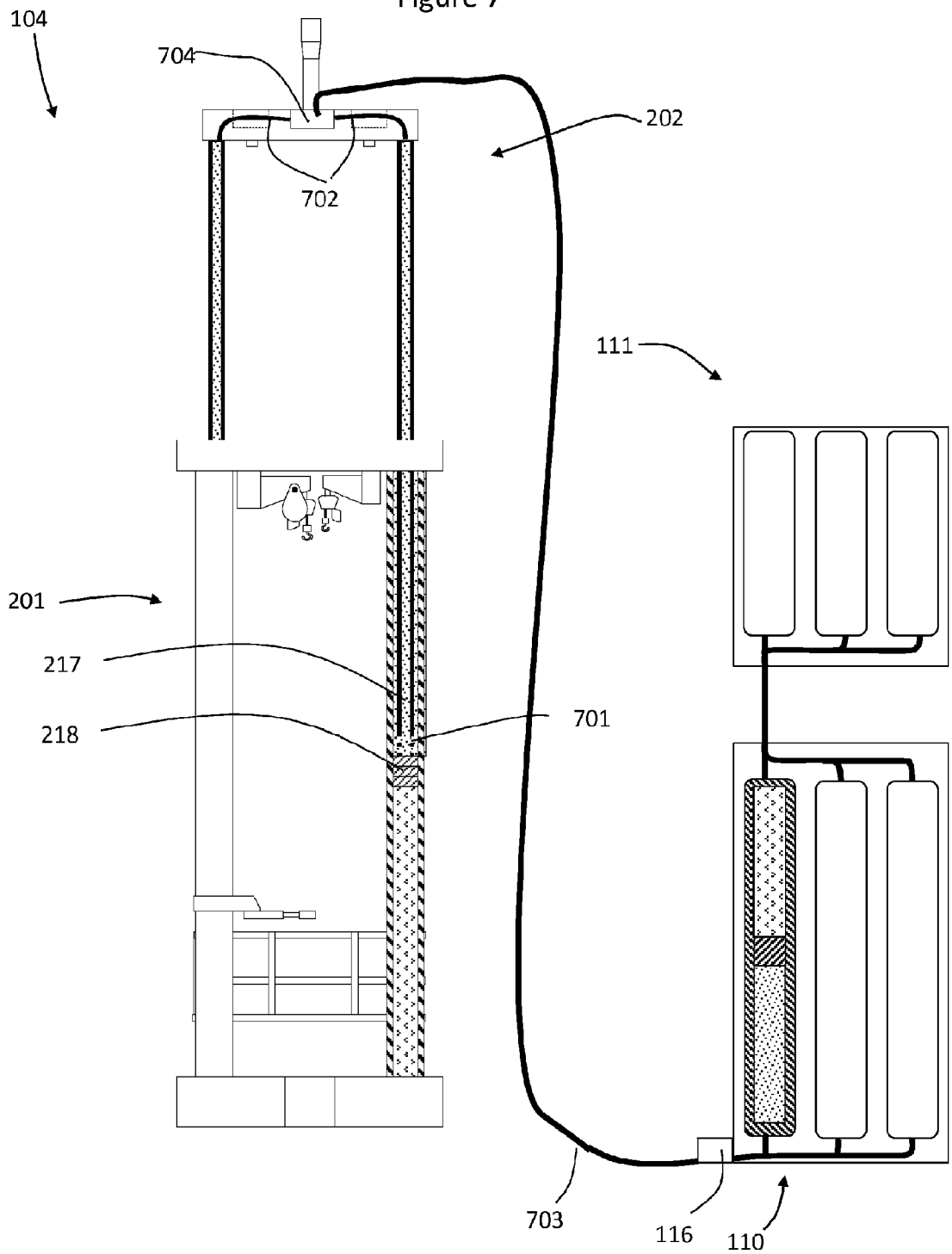

FIG. 7 describes one embodiment of the invention where the piston rods are hollow.

The figures are somewhat schematic and only depict details and equipment necessary for the understanding of the invention. Moreover, the figures may be somewhat distorted with respect to relative dimensions of details and components shown therein. Furthermore, the figures are simplified with respect to the shape and richness in detail of such components and equipment shown therein. Hereinafter, equal, equivalent or corresponding details of the figures will be given substantially the same reference numbers.

SPECIFIC DESCRIPTION OF THE EMBODIMENTS

FIG. 1 illustrates an example of operating according to the invention. A drilling vessel 100 is described only by important components, such as a rig floor 101, a drilling rig 105, which further comprises various components 109 as required to operate and move a load-bearing unit, such as a top drive 108, which is further connected to an elevator 106 via rigid bails 107. Various components 109 further comprise a heave compensator (i.e. a primary heave compensator) as required to compensate vertical movement inflicted onto the drilling vessel by the waves of the sea, further ensuring that other equipment, including the top drive 108 and all equipment attached below the top drive 108, is maintained in a stationary position with required tension applied in accordance with accepted force applied to the equipment located on the seafloor, and hence avoid excessive tensional and compressive forces as the drilling vessel moves vertically up and down as a result of waves of the sea. It should be noted that the various components 109 are not explained in further detail herein as one skilled in the art will understand various methods, apparatuses and devices that exist to allow for functionality of such various components 109, and further that these various methods, apparatuses and devices will not affect the execution of the invention described herein. FIG. 1 further illustrates how a tubular, such as a workover riser 102, is connected to a surface valve arrangement, such as a surface flow tree 103, which in turn is connected to the top drive 108 on the drilling vessel via a lifting arrangement 104, which is defined as an aspect of the invention described herein. The lower end of the workover riser 102 is connected to equipment on the seafloor further defined as a lock to bottom situation. Further, this means that all equipment in the stack, which comprises the workover riser 102, the surface flow tree 103, the lifting arrangement 104, the elevator 106, the rigid bails 107, the top drive 108, and parts of various components 109, are in a stationary mode and hence will not move up and down in relation to the drilling vessel as inflicted by waves of the sea. Due to a heave compensation system part of various components 109, excessive tensional and compressive forces as a result of vertical movement of the drilling vessel will not be Inflicted onto the equipment subjected to a stationary mode as described above. To further describe the invention herein, it is further described that if the heave compensation system (part of various components 109) cease to operate, tensional and compressive forces will be inflicted onto the equipment previously defined to be in a stationary mode. However, such tensional and compressive forces are avoided insofar as the lifting arrangement 104 will start to compensate once the primary heave compensator, as part of various components 109, cease to operate. The functionality and execution of the lifting arrangement 104 is further described in relation to FIGS. 2-4. It should be noted, in relation to FIG. 1, that the lifting arrangement 104 is connected to an accumulator 110 via a hose bundle 113 and a manifold 116. The accumulator 110 is further connected to a pressurized gas system 111 via a hose 114. A hydraulic pumping unit 112 is connected to the hydraulic circuit via the hose 115 and the manifold 116. It should be noted that the pressurized gas system 111 may be executed in various ways, such as a battery comprising several bottles filled with high-pressure gas, or a gas compressor, such as an air compressor. It should further be noted that the hydraulic circuit illustrated represents just one of many control systems and methods possible. One skilled in the art will understand that many control systems and methods are available to allow for the functionality described herein.

FIG. 2 illustrates a generic design further to the invention described herein. In FIG. 2 an embodiment of the lifting arrangement 104 is described, comprising two main subsystems, i.e. a rigid lower frame 201 and an upper portal structure 202. FIG. 2 illustrates the lifting arrangement 104 in a position typical for lifting and rigging up within a rig on a floating drilling vessel. The lower frame 201 comprises a bottom rigid beam 206 with a hydraulically operated connection interface 207, and a control system 208 to which electrical and hydraulic systems are connected. It should be noted that the control system 208 may be part of the lifting arrangement 104 as illustrated in FIG. 2, or alternatively a separate unit placed elsewhere within close vicinity of the lifting arrangement 104. The hydraulically operated interface 207 is typically executed to interface towards surface valve arrangements, such as a surface flow tree 103. The lower frame 201 further comprises a series of legs shaped as cylinders 203, hydraulic and electric conduits 204, a manipulator arm 212, hydraulically operated mechanical locks 230, a work platform 231, and an upper rigid beam 205. The manipulator arm 212 can yield a vertical, rotational, and horizontal movement, and is further described in FIG. 5. The vertical movement of the manipulator arm 212 will be in the axial direction of the cylinders 203, but it should be noted that the manipulator arm 212 may be attached to one of the cylinders 203 or, alternatively, to a separate dedicated system not illustrated in the figures herein. The work platform 231 is included to provide a safe working environment for personnel during handling of various equipment within the lower frame 201, including but not limited to wireline equipment. It should be noted that railings 232 are in a folded position, and the work platform 231 is further folded up against the legs 203 in accordance with a transport and handling position of the lifting arrangement 104. The upper rigid beam 205 typically comprise two winches 209 and 210 and a sheave wheel 211. The two winches may be one smaller size winch 209 and a larger size winch 210. The winches 209, 210 can be rotated around center points 221 and 220, respectively, with respect to the interface towards the upper rigid beam 205, and the winches 209, 210 may be of an electrical or hydraulic execution. It should be noted that, as an alternative, one or more of the winches 209, 210 may be placed inside the upper rigid beam 205, such that the winch line exits from the centre of said beam 205. The upper rigid beam 205 further comprises internal interfaces for the cylinder shaped legs 203. In FIG. 2, this is illustrated by stapled lines 223, which show how the walls of cylinder shaped legs 203 extend through the upper rigid beam 205. The top of the cylinder shaped legs 203 is equipped with an internal seal 219 as required to seal hydraulic fluid within the cylinder body as piston rods 217 move in and out of the cylinders 203. Lines 224 illustrate how piston rods 217 extend through the inside of the cylinders 203 interfaced internally in the upper rigid beam 205. The internal interface may be one of several interfaces or connection means available to ensure a rigid connection between the cylinders 203 and the rigid upper beam 205, but such interfaces are evaluated as known art and are therefore not explained in any more detail herein. The cylinders 203 and upper rigid beam 205 further comprise a channel 222 which connects a high-pressure volume 213 within the cylinders 203 with the hydraulic conduits 204, which in turn is connected to the control system 208 via an internal channel 225 inside the lower rigid beam 206. It should be noted that channels 222 and 225 may also be executed as external conduits and not necessarily as internal channels 222 and 225 within the upper rigid beam 205 and the lower rigid beam 206, respectively, as illustrated in FIG. 2. The bottom of the cylinders 203 are interfaced internally in the lower rigid beam 206, as Illustrated by stapled lines 229. The bottom of the cylinders 203 further comprise a low-pressure volume 227 which may be connected to a low-pressure system via channel 228 and the control system 208. However, it should be noted that the channel 228 may be executed as an external conduit, and this may further be connected to the surrounding atmosphere. One skilled in the art will understand that many different connection designs can be utilized to provide a low-pressure volume within a piston-cylinder arrangement, as described herein. Further to FIG. 2, an upper portal structure 202 is illustrated comprising a series of piston rods 217 and pistons 218 in accordance with the amount of cylinder shaped legs 203, and an upper rigid beam 214 of the portal structure 202. The pistons 218 are equipped with a series of piston seals 226. FIG. 2 further illustrates how the upper portal structure 202 and the lower frame 201 are in a mechanically locked position by means of hydraulically operated mechanical locks 230 being in a engaged position in accordance with a transport and handling position of the lifting arrangement 104. It should be noted that a locked position, as made possible by means of engaging mechanical locks 230, is required to allow for a higher tensional rating of the lifting arrangement 104 during transport and handling compared to an operational mode, which is further described in relation to FIG. 3. The upper rigid beam 214 comprises a connection interface 216, which typically is of an execution interfacing towards a standard elevator 106 as used in typical drilling rigs 105 part of any floating drilling vessel. The upper beam 214 further comprises a connection interface 215, which typically will fit any type rigid bails 107 as is standard lifting equipment on floating drilling vessels. Now that both the lower frame 201 and the upper portal structure 202 are described in detail, it is commonly understood that the lower frames 201 and the upper portal structure 202 can be connected as illustrated in FIG. 2, forming a complete lifting arrangement 104 comprising rigid connections for both sides of the cylinders 203 and the top of the piston rods 217. Further to FIG. 2, it is obvious that once the lower frame 201 and the upper portal structure 202 are connected, they form a hydraulic cylinder piston arrangement which can be extracted and retracted, thereby entailing that the length of the system can be changed in accordance with the total length of the piston rods 217, which in turn means that the upper rigid beam 214 can yield a position, as compared to the upper rigid beam 205, at any length as related to the maximum travel distance in accordance with the length of the piston rods 217. It is further described that all electrical and hydraulic systems part of the lifting arrangement 104, such as a hydraulically operated interface 207, a manipulator arm 212, hydraulically operated mechanical locks 230, winches 209 and 210, a cylinder/piston arrangement 203/217, can be operated via the control system 208 both locally from the lifting arrangement 104, and from a remote panel. It should be noted that a remote panel is not further described herein, but one skilled in the art will understand that electrical and hydraulic functionality can easily be operated both locally and remotely via a control system 208. It should further be noted that all hydraulic components part of the lifting arrangement 104, as described herein, will be operated by means of manipulation of a hydraulic pumping unit (HPU) 112, which in turn is capable of supplying pressurized hydraulic fluid to all hydraulic circuits via the manifold 116.

FIG. 3 illustrates the lifting arrangement 104 in an operational mode, where the pistons 218 are placed in a mid-position with respect to the total travel lengths related to the piston rods 217, which further means that the upper portal structure 202 is elevated compared to the rigid lower frame 201. This operational mode further means that distance 302 and distance 303 is equal or near equal. Such a position may be achieved by lifting the upper portal structure 202 by means of a load-bearing unit, such as the top drive 108 connected via rigid bails 107 to the elevator 106, which in turn is connected to the connection interface 216, while allowing hydraulic fluid from the high-pressure volume 213 to flow back into the accumulator 110 via the control system 208, the hoses being part of the bundle 113, and the manifold 116. It should be noted that the hydraulically operated mechanical locks 230 are in an unengaged and hence retracted position at this time, further allowing the pistons 218 to move freely within the cylinders 203. The lifting arrangement 104 will typically yield a lower tensional strength in an operational mode as compared to a transport and handling mode where the hydraulically operated mechanical locks 230 are in a engaged position as described in relation to FIG. 2. It should also be noted that the work platform 231 is lowered and the railings 232 are elevated into an operational mode. The accumulator 110 may be executed in many ways, but a bottle principal is illustrated in FIG. 3. The accumulator 110 may comprise a series of bottles 304 which comprise a high-pressure liquid volume 307 which is in direct fluid communication with the high-pressure volume 213 via the manifold 116, the hoses being part of the bundle 113, the control system 208, the internal channels 225, the conduits 204, and the Internal channels 222. The accumulator bottles 304 further comprise a high-pressure gas volume 306 which is in direct fluid connection with the pressurized gas system 111, via the hoses 310. The pressurized gas system 111 may be executed in many ways, but a battery with a series of bottles 309 is utilized to describe the concept herein. The bottles 309 may be filled with high-pressure nitrogen. The high-pressure gas volumes 306 and the high-pressure fluid volumes 307 are separated by pistons 305. It should be noted that the pistons 305 are free to move within the bottles 304 as a result of increase or decrease in pressure within the volumes 306 and 307. The pistons 218 and the piston rods 217 can be forced to retract within the cylinders 203 by applying pressurized hydraulic fluid into the hydraulic circuit via the manifold 116, by means of manipulating the HPU 112. It should be noted that such operation of the pistons 218 and the piston rods 217 within the cylinders 203 can be utilized to use the lifting arrangement 104 to lift equipment attached to the lower rigid beam 206 via the hydraulically operated interface 207. By so doing, the lifting arrangement 104 can be utilized to lift and disconnect equipment including but not limited to a workover riser 102, further meaning that the lifting arrangement 104 can be utilized to disconnect from a lock to bottom situation as described herein. In a situation where a primary heave compensator, as part of the various components 109, cease to operate normally, a tensional force will be applied to the upper portal structure 202 as the drilling vessel raises towards the crest of a wave further applying a tensional force to the piston rods 217 and the pistons 218, which in turn will yield a pressure increase within the high-pressure volume 213 within the cylinders 203. Likewise, a compressive force will be applied to the upper portal structure 202 as the drilling vessel travels towards the low point between two waves further applying a compressive force to the piston rods 217 and the pistons 218, which in turn will yield a pressure decrease within the high-pressure volume 213 within the cylinders 203. By so doing, a positive or negative differential pressure will be present with respect to the pressure within the high-pressure volume 213 and the predetermined pressure present in the accumulator 110, which in turn will activate one of several stages part of the control system 208, and a fluid communication will be opened within the control system 208, further meaning that fluid communication is established between the high-pressure volume 213, part of the cylinders 203 of the lifting arrangement 104, and the accumulator 110. As the floating drilling vessel moves up towards the crest of a wave, the upper portal structure 202 will be pulled upwards, further entailing that low-pressure gas enters the low-pressure gas volume 227 via the control system 208 and the channels 228 as the piston rods 217 and the pistons 218 are moved upwards, in relation to the cylinders 203 being part of the stationary lower frame 201, thereby forcing fluid to exit from the high-pressure volume 213, via the channel 222, the conduit 204, the channels 225, the control system 208, the hoses being part of the bundle 113, the manifold 116 and Into the high-pressure liquid volumes 307 being part of the accumulator 110. This will force the pistons 305 to move in an upward direction further compressing the gas within the high-pressure gas volumes 306, hence increasing the pressure within the volumes 306. As the floating drilling vessel moves downward towards the low section between two waves of the sea, the process is reversed, meaning that the higher pressure gas within the volumes 306 of the accumulator will force the pistons 305 downward, further forcing fluid to exit from the volumes 307, via the manifold 116, the hoses being part of the bundle 113, the control system 208, the channels 225, the conduits 204, the channels 222, and into the high-pressure volumes 213 of the cylinders 203. This further means that the pistons 218, and hence the piston rods 217 and the upper portal structure 202, are forced downward, in relation to the cylinders 203 being part of the stationary lower frame 201, and the low-pressure gas within the volumes 227 will exit the system via the channels 228 and the control system 208. These upward and downward movements will be compensated by the processes described, further meaning that equipment defined as locked to bottom herein will not be subjected to excessive tensional and compressive forces. By so doing, the safety of personnel and equipment and the operational efficiency are maintained in situations where a primary rig compensator should cease to operate normally. It should be noted that the upper rigid beam 205 and the lower rigid beam 206 of the lower frame 201 will be in a stationary position respective of each other and regardless of the movement of the upper portal structure 202 in relation to the lower frame 201, further meaning that equipment rigged up within the lower frame 201, including but not limited to wireline equipment, will not be subjected to any moving parts as related to the vertical movement inflicted by the waves of the sea.

FIG. 4 illustrates one embodiment of the control system 208 in more detail. A bundle of hydraulic and/or electric conduits 113 are connected to the control system 208 via a connection interface 402 which is subjected to the accumulator pressure 414 of the system, which in turn is connected to a main hydraulic circuit 405 and a bypass hydraulic circuit 408, which in turn is connected to a hydraulic interface 403 which is subjected to the pressure 413 within the cylinders 203 of the system, which is further connected to channels 225. The bundle of conduits 113 is further connected to a control line 416 via an electric and/or hydraulic interface 415, which in turn is connected to an internal processing unit 401. The bundle of conduits 113 is further connected to electric and/or hydraulic auxiliary lines 418 via an electric and/or hydraulic interface 417, which in turn is connected to an electric switch and/or hydraulically operated valve 422, which in turn is connected to electrical and/or hydraulic output lines 423 via internal electric and/or hydraulic output lines 421 and an electric and/or hydraulic interface 420. The lines 423 are typically connected to conduits 204 via channels 225. The electric switch and/or hydraulically operated valve 422 is controlled by the internal processing unit 401 via electric and/or hydraulic lines 419. The main circuit 405 comprises a sensing device 407, an internal processing unit 401 and an autonomous valve 406, while the bypass circuit can be connected to several stages. For the purpose of FIG. 4, two bypass stages 409 and 411 are included in relation to the control system, but one skilled in the art will understand that more or less stages can be used to allow for redundancy functionality as described herein. It should further be noted that a control system may comprise other components than those described herein, and that the description herein is merely used as an example of how this can be done. The bypass circuit 409 comprises a mechanically operated valve 410, which may be of a pressure relief type. The bypass circuit 411 typically may comprise a weak link element 412, such as a rupture disc. It should be noted that as long as the autonomous valve 406, the mechanically operated valve 410, and the weak link element 412 are closed, the pressure on the cylinder side, as represented by the hydraulic connection 403, will be in accordance with the pressure 413, while the other side of the system, as represented by the hydraulic connection 402, will be in accordance with the pressure 414. The internal processing unit 401 typically comprises electronics and software required to retrieve information and send information to for example a valve actuator. For the purpose of this document, the internal processing unit is described to comprise all such functionality as for example electronics, processing capability, actuators, and hydraulic control components including but not limited to conduits, pilot valves, and reduction valves. Further to explain one embodiment of a control system, a sensing device 407 will read the system pressure, as represented by the pressures 413 and 414, via a line 424 and a line 425, on a continuous basis, which in turn is interpreted by the internal processing unit 401. In a situation where a primary heave compensator cease to operate normally, the pressure 413 will increase or decrease due to relative movement of the pistons 218 within the cylinders 203 as a result of a vertical movement of the floating drilling vessel as inflicted by the waves of the sea. The internal processing unit 401 is programmed to open the valve 406, thereby allowing full fluid communication over the control system 208 once a predetermined positive or negative differential pressure between the pressures 413 and 414 is recorded by the sensing device 407. In case of malfunction of one of the devices 401, 407, or 406, the mechanically operated valve 410 will automatically open at a predetermined positive or negative differential pressure value between the pressures 413 and 414, thereby allowing full fluid communication over the control system 208, where the predetermined differential pressure value is preferably set higher than the differential pressure value determined for the internal processing unit 401 as described above. In case of malfunction of the valve 410, the weak link 412 will break, thereby allowing full fluid communication over the control system once a predetermined differential pressure value is generated between the pressures 413 and 414, where the predetermined differential pressure value is preferably set to a value higher than the set differential pressure value for the valve 410. Several stages as described herein result in a low probability for failure of the control system 208, which in turn will allow for a reliable backup heave compensation system as presented by the invention described herein. The auxiliary system, which comprises the interface 417, the lines 418, the switches and/or valves 422, the lines 421, the interface 420, and the lines 423, is typically a system independent of the main circuit 405 and the bypass circuits 409 and 411. Thereby, the auxiliary system can be utilized to operate components independent of the cylinders 203, the pistons 218, and the piston rods 217 defined as parts of the backup heave compensation system described herein. In one embodiment, the control system 208 may comprise a pressure compensation unit 427 which is subjected to the pressure 414 via the line 428, and to the pressure 413 via the line 426. The pressure compensation unit 427 is typically utilized to allow for pre-job preparation of the hydraulic system within the lifting arrangement 104, and further to alter the system pressure within the high-pressure volume 213 within the cylinder 203 without adding or removing hydraulic fluid, which in turn may be advantageous in a situation where it is required to change the system pressure while in an operational mode. The pressure compensation unit 427 is further described in FIG. 6.

FIG. 5 illustrates an embodiment of a manipulator arm 212 in further detail. In one embodiment, the manipulator arm 212 may comprise an attachment device 501 with rotational movement built in, a telescopic section comprising a cylinder 502 and a piston 503, and a gripping device 504. The manipulator arm 212 can be rotated around a center point 505 by means of hydraulic and/or electric operation of the attachment device 501 or, alternatively, a device attached to the attachment device 501. The manipulator arm 212 can further be extended in a horizontal direction by means of hydraulic and/or electric manipulation of the telescopic functionality maintained by the cylinder 502 and the piston 503. The gripping device 504 can be operated by hydraulic and/or electric means to vary the opening and force between two arms 506 of the gripping device 504. This manipulator arm 212 is typically used to allow safe handling of equipment being lifted into or out from the lifting arrangement 104 including, but not limited to, wireline equipment.

FIG. 6 illustrates an embodiment of a pressure compensation unit 427 in further detail. The pressure compensation unit 427 may comprise lines 426 and 428 which subject a valve 601 and a valve 607, respectively, to the pressures 413 and 414, respectively. The pressure compensation unit 427 further comprises a pressure compensation element 608 such as for example a bellows arrangement commonly known to one skilled in the art, which is connected to the valve 601 via the line 602, and to the valve 607 via the line 606. The system may further comprise a connection 604 utilized to ensure that the pressure in the lines 602 and 606 is equal to the pressure in the lines 426 and 428, respectively, prior to opening the valves 601 and 607. Line 603 is connected between line 602 and connection 604. Line 605 is connected between connection 604 and line 606. The pressure compensation unit 427 is typically utilized to compensate the pressure on two sides of a hydraulic system without adding or removing hydraulic fluid, which entail that the operating pressure of the high-pressure volumes 213 can be changes without establishing fluid communication between the high-pressure volumes 213 and the HPU 112 via the hoses being part of the bundle 113. The pressure compensation unit 427 further entails that the system can be filled with hydraulic fluid and vented for gas bubbles prior to transport from a workshop facility to the floating drilling vessel, which in turn will simplify operational procedures and time required to transport and handle the lifting arrangement 104 on the floating drilling vessel.

FIG. 7 represents another embodiment of the present invention illustrating an alternate way of communicating hydraulic fluid between the accumulator 110 and the high-pressure volume 213 within the cylinders 203 (cf. FIGS. 1-3). In this embodiment, hydraulic fluid is directed from the accumulator 110 and said manifold 116 via a separate hydraulic hose 703 connected, at its opposite end, to a control valve 704 and associated hydraulic fluid conduits 702. The control valve 704 and the hydraulic fluid conduits 702, which form part of said control system 208 (cf. FIGS. 1 and 2), are connected to the upper rigid beam 214 of said upper portal structure 202. Moreover, each piston rod 217 is hollow in this embodiment, thereby allowing hydraulic fluid to be directed from the control valve 704, via a respective hydraulic fluid conduit 702 and into an upper end of the piston rod 217, as shown in FIG. 7. Furthermore, the lower end of each piston rod 217 is provided with flow ports 701 for allowing the hydraulic fluid to be directed through the hollow piston rod 217 and onwards into the high-pressure volume 213 of each cylinder 203. As an alternative or addition, these flow ports 701 can be integrated in the upper side of each piston 218 so as to allow hydraulic communication with the high-pressure volume 213 of each cylinder 203. Advantageously, and due to the hollow piston rods 217 and the omission of said hydraulic and electric conduits 204 (cf. FIGS. 2 and 3), this embodiment allows the overall weigh of the lifting arrangement 104 to be reduced significantly, which again is of great importance on a floating drilling vessel.

Finally, the descriptions and drawings presented herein only represent examples of embodiments related to the invention. Further, any concept, system and method as well as combination(s) of concept(s), system(s) and method(s) described in any text or figure herein could be extended to apply in conjunction or combination with other concepts, systems and methods described in the art. All combinations of concepts, systems and/or methods also comprise part of the objective of the invention. All interfacing, combination and utilisation with existing equipment, techniques and methods also comprise part of the invention.

The invention claimed is:

1. A backup heave compensation system on a floating drilling vessel, the vessel comprising a rig structure for carrying out well operations in a subsea well, the rig structure comprising a primary heave compensation system operatively connected to a load-bearing structure capable of supporting a tubular structure connected between the floating drilling vessel and the subsea well, the backup heave compensation system comprising:

a vertically extendable and retractable lifting arrangement structured for connection between the load-bearing structure and the tubular structure;

a hydraulic system operatively connected to the lifting arrangement; and a control system operatively connected to the lifting arrangement and hydraulic system for selective control and operation thereof; the lifting arrangement comprising:

a rigid frame structure comprised of: at least two vertically extending legs in the form of cylinders separated at a distance from each other; a first transverse element connecting first end portions of the cylinders; and a second transverse element connecting second end portions of the cylinders; and a portal structure comprised of: at least two vertically extending legs in the form of piston rods having first end portions provided each with a piston; and a transverse portal element rigidly connecting second end portions of the piston rods;

wherein each piston of the portal structure is inserted into, and is movable within, a corresponding cylinder of the frame structure such that the transverse portal element moves in unison with the piston rods towards and away from the cylinders, thereby allowing the portal structure and the frame structure to be vertically movable with respect to one another, each cylinder and each piston defining a cylinder-piston arrangement;

wherein the hydraulic system is connected to a high-pressure volume of each cylinder for selective hydraulic communication with the high-pressure volume and the piston;

wherein the cylinders are connected to the control system; and wherein the control system is structured in a manner allowing it to selectively control and operate the cylinder-piston arrangement so as to compensate for heave movements of the floating drilling vessel should the primary heave compensation system become inoperative.

2. The backup heave compensation system according to claim 1, wherein the cylinder-piston arrangement of the lifting arrangement comprises a releasable piston locking system structured for selective locking of the pistons in the cylinders, thereby allowing the portal structure to be locked with respect to the frame structure when the lifting arrangement is in a static, inoperative position in an operational mode.

3. The backup heave compensation system according to claim 2, wherein the piston locking system comprises at least one pressure-containment means structured for selective locking of a given hydraulic pressure in the high-pressure volume of each cylinder.

4. The backup heave compensation system according to claim 2, wherein the piston locking system is operatively connected to said control system for selective control and operation of the piston locking system.

5. The backup heave compensation system according to claim 1, wherein the lifting arrangement comprises a releasable frame locking system structured for selective locking of the rigid frame structure to the portal structure when the lifting arrangement is retracted in a rig-up mode.

6. The backup heave compensation system according to claim 5, wherein the frame locking system comprises at least one mechanical lock.

7. The backup heave compensation system according to claim 6, wherein the mechanical lock is arranged between the rigid frame structure and the transverse portal element of the portal structure.

8. The backup heave compensation system according to claim 5, wherein the frame locking system is operatively connected to the control system for selective control and operation of the frame locking system.

9. The backup heave compensation system according to claim 1, wherein the portal structure is positioned above the rigid frame structure so as to form an upper part of the lifting arrangement, whereby the frame structure forms a lower part of the lifting arrangement.

10. The backup heave compensation system according to claim 1, wherein the portal structure is positioned below the rigid frame structure so as to form a lower part of the lifting arrangement, whereby the frame structure forms an upper part of the lifting arrangement.

11. The backup heave compensation system according to claim 1, wherein the piston rods of the portal structure are hollow;

wherein the second end portion of each piston rod is structured for communicating a hydraulic fluid with the control system and hydraulic system; and wherein the first end portion of each piston rod is structured for communicating the hydraulic fluid between the hollow piston rod and the corresponding cylinder surrounding the piston rod.

12. A lifting arrangement capable of operating as a backup heave compensator on a floating drilling vessel comprising a rig structure, the rig structure comprising a primary heave compensation system operatively connected to a load-bearing structure, the lifting arrangement hanging from the primary heave compensating system and comprises:

a rigid frame structure comprised of: at least two parallel legs in the form of cylinders separated at a distance from each other; a first transverse element connecting first end portions of the cylinders; and a second transverse element connecting second end portions of the cylinders; and a portal structure comprised of: at least two parallel legs in the form of piston rods having first end portions provided each with a piston; and a transverse portal element rigidly connecting second end portions of the piston rods;

wherein each piston of the portal structure is inserted into, and is movable within, a corresponding cylinder of the frame structure such that the transverse portal element moves in unison with the piston rods towards and away from the cylinders, thereby allowing the portal structure and the frame structure to be movable with respect to one another, each cylinder and each piston defining a cylinder-piston arrangement;

wherein a high-pressure volume of each cylinder is structured for hydraulic communication with an associated hydraulic system; and wherein the cylinders are structured for connection to an associated control system for selective control and operation of the hydraulic system and the cylinder-piston arrangement so as to compensate for heave movements of the floating drilling vessel.

13. The lifting arrangement according to claim 12, wherein the cylinder-piston arrangement comprises a releasable piston locking system structured for selective locking of the pistons in the cylinders, thereby allowing the portal structure to be locked with respect to the frame structure when the lifting arrangement is in a static, inoperative position in an operational mode.

14. The lifting arrangement according to claim 13, wherein the piston locking system comprises at least one pressure-containment means structured for selective locking of a given hydraulic pressure in the high-pressure volume of each cylinder.

15. The lifting arrangement according to claim 13, wherein the piston locking system is structured for connection to the control system for selective control and operation of the piston locking system.

16. The lifting arrangement according to claim 12, wherein the lifting arrangement comprises a releasable frame locking system structured for selective locking of the rigid frame structure to the portal structure when the lifting arrangement is retracted in a rig-up mode.

17. The lifting arrangement according to claim 16, wherein the frame locking system comprises at least one mechanical lock.

18. The lifting arrangement according to claim 17, wherein the mechanical lock is arranged between the rigid frame structure and the transverse portal element of the portal structure.

19. The lifting arrangement according to claim 16, wherein the frame locking system is structured for connection to the control system for selective control and operation of the frame locking system.

20. The lifting arrangement according to claim 12, wherein the transverse portal element of the portal structure comprises a connection interface for releasable connection to a load-bearing structure on the floating drilling vessel.

21. The lifting arrangement according to claim 12, wherein the first transverse element of the frame structure comprises a connection interface for releasable connection to a load-bearing structure on the floating drilling vessel.

22. The lifting arrangement according to claim 12, wherein the piston rods of the portal structure are hollow;

wherein the second end portion of each piston rod is structured for communicating a hydraulic fluid with the control system and the hydraulic system; and wherein the first end portion of each piston rod is structured for communicating the hydraulic fluid between the hollow piston rod and the corresponding cylinder surrounding the piston rod.

* * * * *